US005984804A

United States Patent [19]

Berg

[11] Patent Number: 5,984,804

[45] **Date of Patent: *Nov. 16, 1999**

[54] LIGHTWEIGHT SHAFT AND METHODS OF MAKING SAME

[75] Inventor: Jerome S. Berg, Memphis, Tenn.

[73] Assignee: True Temper Sports, Inc., Memphis, Tenn.

[ * ] Notice: Under 35 U.S.C. 154(b), the term of this patent shall be extended for 82 days.

[21] Appl. No.: 08/613,792

[22] Filed: Mar. 1, 1996

[51] Int. Cl.[6] ..... A63B 53/10

[52] U.S. Cl. ..... 473/319; 273/DIG. 7; 273/DIG. 23

[58] Field of Search ..... 473/409, 319, 473/318, 312, 332, 316, 320; 273/DIG. 23, DIG. 7

[56] References Cited

U.S. PATENT DOCUMENTS

| | | | |
|---|---|---|---|
| 2,282,614 | 5/1942 | Smith | 473/310 |
| 2,822,175 | 2/1958 | Redmond | 473/310 |
| 4,082,277 | 4/1978 | Van Auken et al. | 473/320 |
| 4,084,819 | 4/1978 | Van Auken | 473/320 |
| 4,132,579 | 1/1979 | VanAuken | 156/189 |
| 4,173,670 | 11/1979 | VanAuken | 138/123 |
| 4,470,600 | 9/1984 | Parente et al. | 473/308 |
| 4,757,997 | 7/1988 | Roy | 473/319 |
| 4,803,023 | 2/1989 | Enomoto | 473/338 |
| 4,819,939 | 4/1989 | Kobayashi | 473/299 |
| 4,889,575 | 12/1989 | Roy | 156/189 |
| 5,088,735 | 2/1992 | Shigetoh | 473/320 |
| 5,258,088 | 11/1993 | Wu | 156/294 |
| 5,324,032 | 6/1994 | Minami | 473/320 |
| 5,326,099 | 7/1994 | Yamamoto et al. | 473/315 |
| 5,385,767 | 1/1995 | Noguchi | 428/36.91 |
| 5,427,373 | 6/1995 | Kusumoto | 473/319 |
| 5,437,450 | 8/1995 | Akatsuka | 473/320 |
| 5,454,563 | 10/1995 | Nagamoto | 473/312 |
| 5,547,189 | 8/1996 | Billings | 473/305 |

*Primary Examiner*—Jeanette Chapman
*Assistant Examiner*—Stephen L. Blau
*Attorney, Agent, or Firm*—Harness, Dickey & Pierce, P.L.C.

[57] ABSTRACT

A lightweight shaft 22 includes a plurality of non-metallic fibers 42, 63, 66 and 70 arranged in prescribed orientations from one end of the shaft to the other and carried by a cured plastic material 103. Additional fibers 82 and 84 are carried by the cured plastic material 103 and are located at a butt end 28 of the shaft 22 to form a strengthening band 104 which precludes splitting and cracking of the shaft at the butt end. A lightweight filler element 106, which is composed of a rigid foam material, is located within a portion 27*a* of an opening 27 at a tip end 30 of the shaft 22 to strengthen the tip end.

28 Claims, 3 Drawing Sheets

LIGHTWEIGHT SHAFT AND METHODS OF MAKING SAME

BACKGROUND OF THE INVENTION

This invention relates to a lightweight shaft and methods of making the shaft and particularly relates to a lightweight shaft which forms a portion of a golf club and to methods of making the lightweight shaft for a golf club.

Golf clubs typically include a club head secured to a tip end of a club shaft and a hand grip assembled at a butt end of the shaft. The butt end of the shaft is formed with a uniform diameter of a first prescribed axial length which is larger than a uniform diameter of the tip end of a second prescribed axial length. A shaft of this type is referred as having a parallel butt and a parallel tip. The portion of the shaft which extends between the butt end and the tip end thereof is usually tapered from the larger diameter at the butt end to the smaller diameter of the tip end. The butt end and the tip end of the shaft could also be tapered or straight with a uniform diameter as noted above, or one could be tapered and the other straight.

In playing the game of golf, a golfer swings the club and aims the head thereof toward a golf ball which is located, for example, on a ground level surface. Ideally, when the club head strikes the ball, the ball is directed in a long trajectory toward, and on line with, an associated hole-like cup located on a fine grass surface.

Many years ago, shafts for golf clubs were made from wood such as, for example, hickory which was suitable for the bending and twisting to which the club was subjected when swung by the golfer. However, the use of wood for the shafts influenced the manner in which the golfer had to swing the club. Later, clubs with metal shafts, such as steel shafts, were developed and evolved into a highly successful product which enhanced the golfers playing of the game. In recent years, clubs with non-metallic shafts have been developed and provide a viable and popular option to the use of the metal shafts. The non-metallic shafts are typically made from blended layers of fiber reinforced polymer matrix composites such as, for example, graphite fibers carried in a prescribed pattern within an epoxy matrix.

There are several factors which are considered when designing a golf club to enhance the playing of the game. Perhaps the most important factor is the weight of the shaft. One of the parameters which is considered in the use of a golf club is the "swing weight" of the club. The swing weight parameter represents generally the weight of the club as it is being swung and is related to the overall weight and the weight distribution in the club. Clubs are classified in several principal grades, and several sub grades within each principal grade, based on the swing weight of the clubs. Generally, the lighter weight clubs are used by the weaker hitters while the heavier weight clubs are used by the stronger hitters such as the low-handicap and professional golfers.

The development of the composite shaft resulted in a shaft which is lighter in weight than the steel shaft and thereby presented a weight enhancement, particularly for the weaker hitters who use the low swing-weight clubs.

When the composite shaft was developed, it provided an option for some golfers to switch from a club with the heavier metal shaft to a club with the lighter composite shaft if the golfer experienced improved play with the lighter club. Also, with the lighter composite club, the weight of the club head could be increased slightly whereby the speed of the head is increased which translates into increases in ball speed and distance thereby further enhancing the golfers playing of the game.

With the realization and recognition that the above-noted advantages can be attained by using the lighter composite clubs, there is a need to develop even lighter clubs to provide further enhancement of the playing of the game by golfers.

SUMMARY OF THE INVENTION

It is, therefore, an object of this invention to provide a lightweight shaft.

Another object is to provide a lightweight shaft for use as a component of a golf club to enhance the feel and playability of the club.

A further object of this invention is to provide a lightweight shaft which can be used to form a component of any type of golf club such as woods, irons, wedges or putters.

Still another object of this invention is to provide a low cost composite shaft for use as a lightweight component of a golf club.

With these and other objects in mind, this invention contemplates a lightweight shaft which includes a non-metallic body formed in a prescribed length along a linear axis thereof. The body includes a first layer of a material including fibers extending generally in an axial direction along the length of the body. The body further comprises a second layer of material over the first layer and includes at least two sets of fibers arranged in a biased matrix with respect to each other. A third layer forms a portion of the body and is located over the second layer. The third layer is comprised of fibers extending generally in an axial direction of the body. The first, second and third layers are carried within a cured plastic matrix. The body is formed with an end along the axis thereof with an opening formed in the end in a generally axial direction. A lightweight filler element is located within the opening of the body.

This invention further contemplates a lightweight shaft which includes a non-metallic body formed in a prescribed length along a linear axis thereof. The body includes a first layer of a material including fibers extending generally in an axial direction along the length of the body. The body further comprises a second layer of material over the first layer and includes at least two sets of fibers arranged in a biased matrix with respect to each other. A third layer forms a portion of the body and is located over the second layer. The third layer is comprised of fibers extending generally in an axial direction of the body. A fourth layer of material forms a portion of the body and is located over a portion of the third layer adjacent an axial end of the body. The first, second, third and fourth layers are carried within a cured plastic matrix.

This invention further contemplates a method of making a lightweight shaft which includes the steps of forming at least a first sheet and a second sheet of a material having a plurality of non-metallic fibers extending in a generally-parallel longitudinal direction and carried by an uncured plastic material which forms a portion of the first and second sheets. A third sheet and a fourth sheet of material are formed wherein each sheet includes a first plurality of non-metallic fibers extending in a generally parallel alignment and also include a second plurality of non-metallic fibers which are in a generally parallel alignment. The first plurality of fibers cross the second plurality of fibers at a prescribed angle of fiber orientation. The first and second plurality of fibers of each of the third and fourth sheets of material are carried in the angled orientation by an uncured plastic material which also forms a portion of the third and fourth sheets.

The first sheet of material is wrapped around a rigid mandrel such that the fibers thereof extend longitudinally of the mandrel. The third sheet of material is wrapped around and covers the first sheet of material. Thereafter, the second sheet of material is wrapped around and covers the third sheet of material such that the plurality of fibers of the second sheet extend longitudinally of the mandrel. The fourth sheet of material is wrapped around and covers a portion of the second sheet of material which extends from a first end of the second sheet for a prescribed distance toward a second end of the second sheet to thereby form an assembly.

The assembly is processed to cause the uncured plastic material of the first, second, third and fourth sheets of material to blend together and cure in a unitized structure. Thereafter the mandrel is removed to provide the lightweight shaft with four layers of material having non-metallic fibers oriented in a prescribed manner.

This invention also contemplates another method of making a lightweight shaft in a manner similar to the method set forth above. In this method, the fourth sheet of material is excluded and an opening is formed in one axial end of the cured first, second and third layers of material which appears upon removal of the mandrel. Thereafter, a lightweight filler element is placed, and extends for a prescribed distance, in the opening to complete the lightweight shaft.

Other objects, features and advantages of the present invention will become more fully apparent from the following detailed description of the preferred embodiment, the appended claims and the accompanying drawings.

DESCRIPTION OF THE PREFERRED EMBODIMENT

Figure 1:
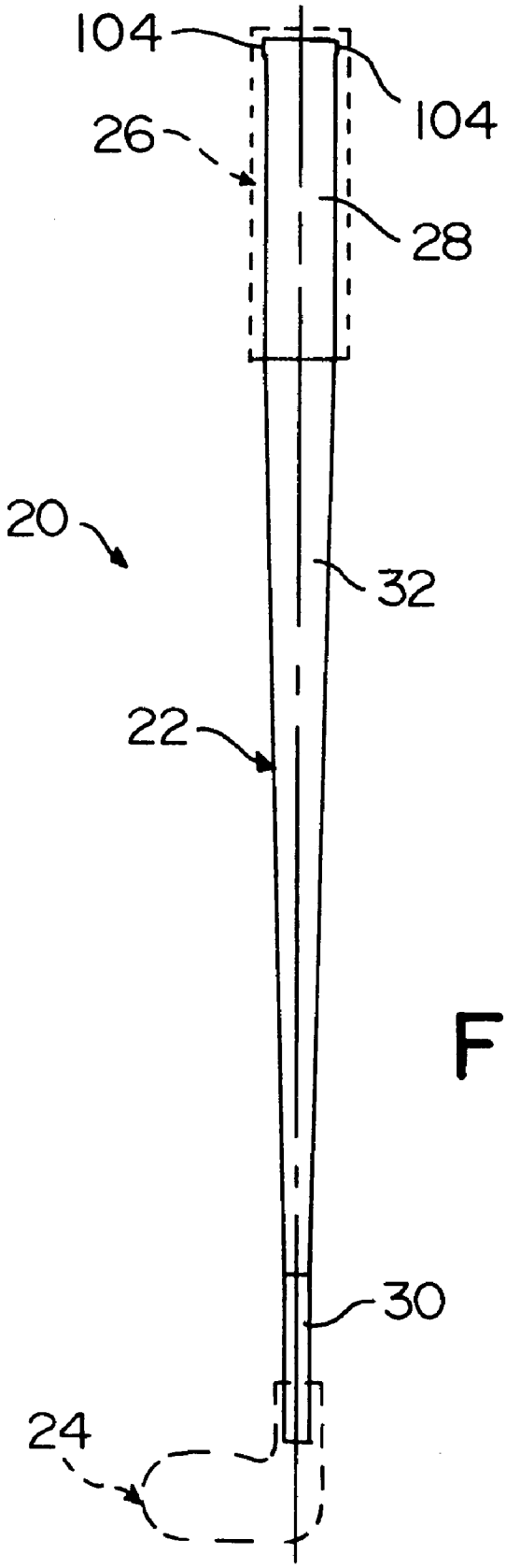
FIG. 1 is a side view showing a golf club shaft with a grip and head shown in phantom.

Referring to FIG. 1, a golf club 20 is formed by a shaft 22, a club head 24, shown in phantom, and a grip 26, also shown in phantom. The shaft 22, which is generally tubular with an axial opening 27 (FIG. 9), is formed with a butt end 28 to which the grip 26 is attached and is also formed with a tip end 30 to which the head 24 is secured. An intermediate section 32 of the shaft 22 extends between the butt end 28 and the tip end 30 thereof and tapers uniformly and inward from an inboard extremity of the butt end to an inboard extremity of the tip end. The butt end 28 and the tip end 30 are each of a uniform diameter in the preferred embodiment. However, either or both of the butt and tip ends could be tapered or the entire shaft 22 could be tapered from one extremity to the other, all without departing from the spirit and scope of the invention.

As shown in FIG. 2, 3, 4 and 5, the shaft 22 could be formed by a first sheet 34, a second sheet 36, a third sheet 38 and a fourth sheet 40, respectively, each of which is composed of a composite material including graphite fibers and an epoxy resin matrix which carries the fibers therein.

Figure 2:
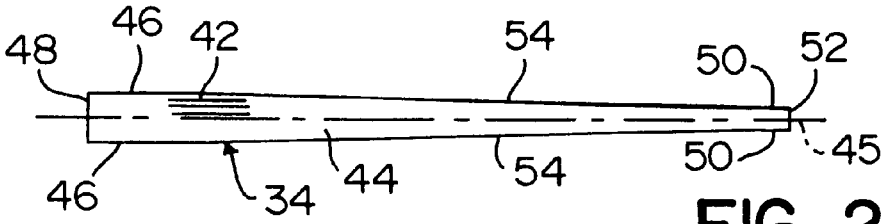
FIG. 2 is a view of a first sheet of composite material having a plurality of parallel non-metallic fibers extending from one end to an opposite end of the sheet carried in an uncured plastic material.

As shown in FIG. 2, the first sheet 34 is formed by a plurality of spaced parallel graphite fibers 42 and an epoxy resin matrix 44. The first sheet 34 is formed in an elongated shape symmetrically on opposite sides of an axis 45 with widely spaced, parallel opposing sides 46 at one end 48 thereof and narrowly spaced, parallel sides 50 at an opposite end 52 thereof. Intermediate sides 54 of the first sheet 34 taper inward toward the axis 45 from an inboard extremity of the parallel sides 46 to an inboard extremity of the parallel sides 50. The parallel fibers 42 extend longitudinally of the sheet 34 in an axial direction from the end 48 to the end 52 of the sheet.

Figure 3:
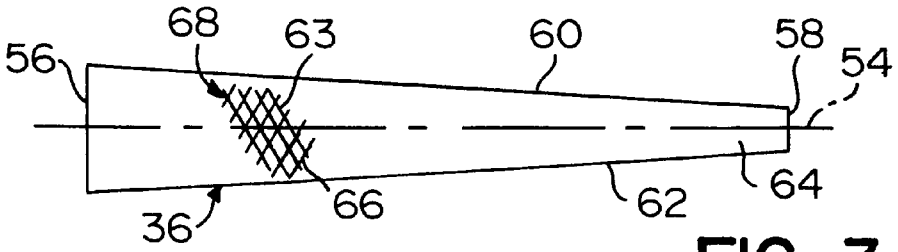
FIG. 3 is a view of a second sheet of composite material having a first plurality of parallel non-metallic fibers extending angularly from one side of the sheet to an opposite side and woven with a second plurality of parallel non-metallic fibers which also extend from the one side to the other side of the sheet all carried in an uncured plastic material.

Referring to FIG. 3, the second sheet 36 is formed about an axis 54 with a wide end 56 and a narrow end 58 spaced from the wide end. Sides 60 and 62 of the sheet 36 are spaced equally on each side of the axis 54 with both sides 60 and 62 tapering inward toward the axis from the wide end 56 to the narrow end 58. The sheet 36 further includes a first set of graphite fibers 63 carried by an epoxy resin matrix 64 and extend angularly with respect to the axis 54 from the side 60 to the side 62 thereof. Another set of graphite fibers 66 are carried by the epoxy resin matrix 64 and extend angularly with respect to the axis 54 in a direction opposite the angular extension of the first set of fibers 63 such that the fibers 63 and 66 cross each other to form a fiber matrix 68.

In the preferred embodiment, the fibers 63 cross the axis 54 at an angle of forty-five degrees while the fibers 66 cross the axis at an angle of minus forty-five degrees whereby the fibers 63 cross the fibers 66 at an angle of ninety degrees. Other crossing angles could be used without departing from the spirit and scope of the invention. Further, in the preferred embodiment, the fibers 63 are woven with the fibers 66 in an interlaced fashion so that the fibers are held together in the context of a woven fabric. The fibers 63 and 66 could be formed in an overlapping fashion rather than in an interlacing weave without departing from the spirit and scope of the invention.

Figure 4:
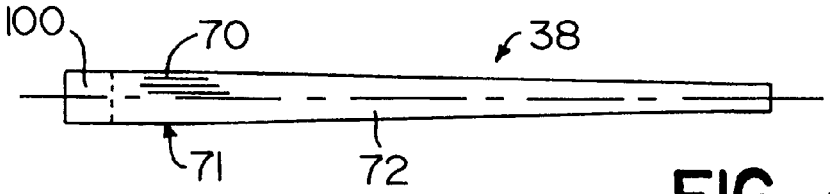
FIG. 4 is a view of a third sheet of composite material having a plurality of parallel non-metallic fibers carried in an uncured plastic material in an orientation similar to the composite material of FIG. 2.

The sheet 38 of composite material as shown in FIG. 4 includes the same structural orientation and arrangement of a plurality of graphite fibers 70 carried by an epoxy resin matrix 72 as the fibers 42 and the matrix 44 of the sheet 34. The sheet 38 includes an end section 71 of uniform width which contributes to the formation of the butt end 28 of the shaft 22 (FIG. 1).

Figure 5:
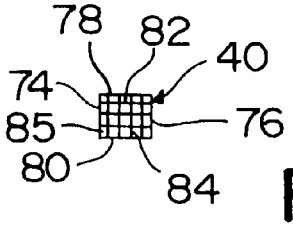
FIG. 5 is a view of a sheet of composite material having a first plurality of parallel non-metallic fibers extending perpendicularly from one side to an opposite side of the sheet and a second plurality of parallel non-metallic fibers woven with and extending perpendicularly to the first plurality of fibers all carried in an uncured plastic resin in accordance with certain principles of the invention.

Referring to FIG. 5, the sheet 40 is defined by spaced ends 74 and 76, and by spaced sides 78 and 80. The sheet 40 is formed by a first set of spaced, parallel graphite fibers 82 which extend between, and are perpendicular with, the ends 74 and 76 of the sheet. A second set of spaced, parallel graphite fibers 84 extend between, and are perpendicular with, the sides 78 and 80 of the sheet 40 whereby the fibers 82 are perpendicular with the fibers 84 and are arranged in a ninety-degrees matrix. The sheet 40 further includes an epoxy resin matrix 85. In the preferred embodiment, the fibers 82 are interlaced, or woven, with the fibers 84 in the context of a woven fabric. However, the fibers 82 and 84 could be formed in an overlapped fashion rather than as an interlaced weave without departing from the spirit and scope of the invention.

In the preferred embodiment of the invention, the composite material of the sheets 34, 36, 38 and 40 are formed with graphite fibers and an epoxy resin matrix. The fibers could be formed from fiberglass, aramid, boron or other suitable fiber materials, and the epoxy resin matrix could be polyester, vinylester, nylon or any other suitable thermoset or thermoplastic matrix, all without departing from the spirit and scope of the invention.

It is noted that number of fibers 42, 63, 66, 70, 82 and 84 shown in FIGS. 2, 3, 4 and 5 is limited for illustration purposes only to show the alignment and orientation of the much larger number of fibers actually contained in their respective sheets 34, 36, 38 and 40.

Sheet 34 is commercially available under Product Code NCT-301-1X(34-700) from Newport Adhesives and Composites, Inc., 1822 Reynolds Avenue, Irvine, Calif. 92714. Sheets 36 and 40 can be formed from the same commercially available material which is available under Product Code 341, 1k Plain Weave from Fiberite, Inc., 4300 Jackson Street, Greenville, Tex. 75401. Sheet 38 is commercially available under Product Code NCT-301-1X (MR40) from Newport Adhesives and Composites, Inc. whose address is noted above.

Figure 6:
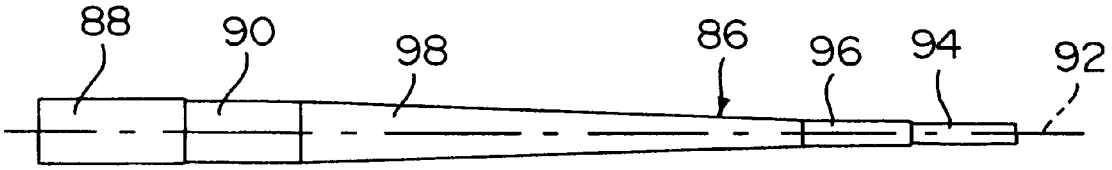
FIG. 6 is a side view of a steel mandrel.

As shown in FIG. 6, a rigid mandrel 86 is formed in a rod-like shape from any suitable material such as, for example, steel. The mandrel 86 is formed with large end section 88 of a first prescribed uniform diameter and a first intermediate uniform section 90 of a second prescribed uniform diameter slightly less than the first prescribed diameter. The section 88 is integrally joined with the section 90 along an axis 92 of the mandrel. The mandrel 86 is further formed with a small end section 94, spaced along the axis 92 of the mandrel from the sections 88 and 90, and a second intermediate uniform section 96 which is integrally joined with the section 94 along the axis 92.

Figure 9:
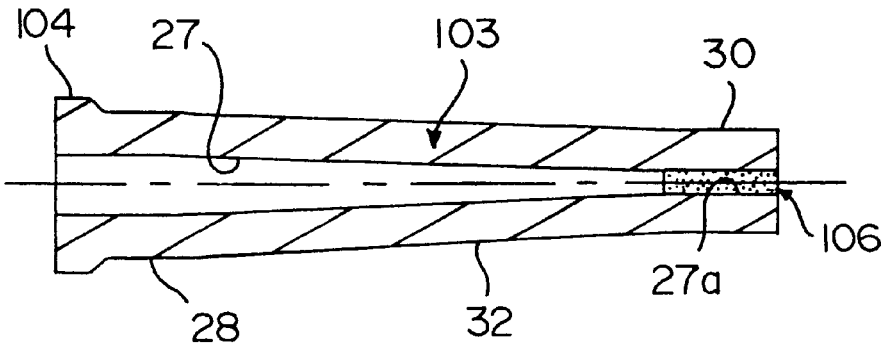
FIG. 9 is a partial sectional view of a tip end of the shaft of FIG. 1 showing the assembly of the lightweight filler element of FIG. 8 within an axial opening of the tip end in accordance with certain principles of the invention.

The section 96 is formed with a third prescribed uniform diameter somewhat less that the second prescribed diameter while the section 94 is formed with a fourth prescribed uniform diameter which is slightly less than the third prescribed diameter. A uniformly tapered section 98 is integrally joined at one end thereof with an inboard extremity of the first intermediate section 90, and extends to, and integrally joins with, an inboard extremity of the second intermediate section 96. The diameters of the first intermediate section 90, the tapered section 98 and the second intermediate section 96 form the internal diameters of the axial opening 27 (FIG. 9) of the butt end 28, the intermediate section 32 and the tip end 30, respectively, of the shaft 22 (FIGS. 1 and 9).

In the manufacture of the lightweight shaft 22, the first sheet 34 of composite material is wrapped longitudinally around the mandrel 86 with the fibers 42 extending in parallel with the axis 92 of the mandrel. The second sheet 36 of composite material is then wrapped over and covers the first sheet 34 with the fibers 63 and 66 being at a plus forty-five degrees bias and a minus forty-five degrees bias, respectively, with the axis 92 of the mandrel 86.

The fiber matrix 68 carried by a single layer of the epoxy resin matrix 64 is used effectively as two layers of fibers but with only the single layer of epoxy resin matrix 64. In this manner, the shaft 22 is lighter than a shaft which includes two single layers, each of which would contain a plurality of fibers and an epoxy resin matrix. Further, when the sheet 36 is wrapped over the wrapped sheet 34, only two seams will result from the wrapping of the sheet 36. If two separate sheets of material had been used in place of the single sheet 36 to achieve the biased matrix of fibers 63 and 66, four seams would have resulted from the double-sheet wrappings. Thus, the use of the single sheet 36 reduces the number of seams in the final product and contributes to the lighter weight shaft 22.

The third sheet 38 of composite material is wrapped over and covers the second sheet 36 with the fibers 70 being aligned and parallel with the axis 92 of the mandrel.

Figure 10:
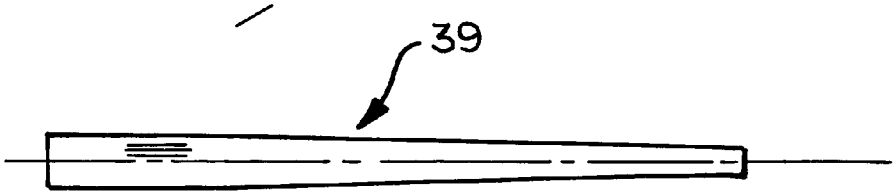
FIG. 10 is a view of an intermediate sheet which is identical to physical size, shape composition of the third sheet of FIG. 4.

In the preferred embodiment, another or intermediate sheet 39 (FIG. 10) identical in structure and composition to the sheet 38, is wrapped over and covers the sheet 38 in the same manner as sheet 38 is wrapped around sheet 36. The additional sheet which is identical to sheet 38 is the same commercially available material identified above with respect to sheet 38.

The sheet 40 of composite material is then wrapped around and covers an end portion 100 (FIG. 4) of the end section 71 of the previously wrapped sheet 38. In the preferred embodiment, the end section 71 is about ten inches in axial length and the axial length of the end portion 100, which is covered by the sheet 40, is about three inches. The lengths of the end section 71 and the end portion 100 could be different from the preferred embodiment without departing from the spirit and scope of the invention. In addition, the angular relationship between the fibers 82 and 84 of the sheet 40, and between the fibers 82 and 84 on the one hand and the ends 74 and 76 and the sides 78 and 80 on the other hand, could be different than that described above without departing from the spirit and scope of the invention.

Figure 7:
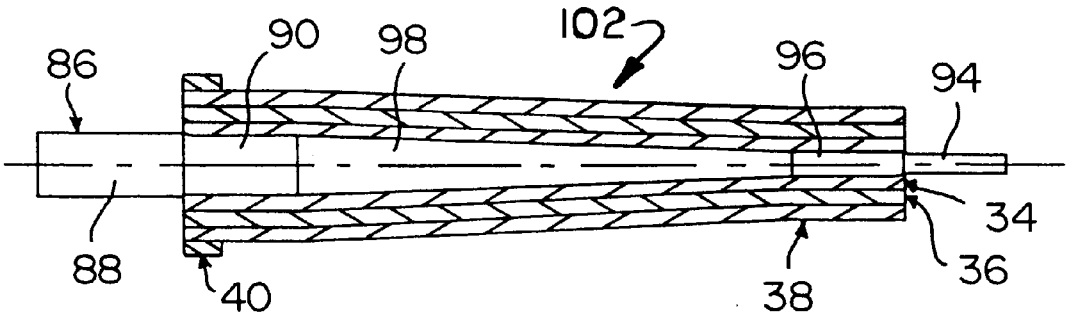
FIG. 7 is a partial sectional view showing the sheets of FIGS. 2, 3, 4 and 5 wrapped on the mandrel of FIG. 6 in accordance with certain principles of the invention.

Upon the completion of the assembly of the sheets 34, 36, 38 and 40 on the mandrel 86 as described above, a subassembly 102 is thereby formed as illustrated in FIG. 7. A heat-shrinkable film (not shown) is wrapped around the subassembly 102 so that all portions of the sheets 34, 36, 38 and 40 are confined between the mandrel 86 and the heat-shrinkable tape. The film-wrapped subassembly 102 is then processed through a heated environment where the epoxy resin matrices 44, 64, 72 and 85 of the sheets 34, 36, 38 and 40, respectively, are liquified and generally blend together as a homogenous mass. During this period, the film shrinks to define generally the exterior shape and dimensions of the shaft 22. The film-wrapped subassembly 102 is removed from the heated environment and is cooled to cure the homogenized epoxy resin, appearing as a cured mass of plastic material 103 in FIG. 9, in the configuration defined by the mandrel 86 and the heat-shrunk film. The film is removed from the cured subassembly 102 and the mandrel 86 is removed to reveal the shaft 22 generally in the configuration shown in FIG. 9 where the opening 27 is configured by the shape of the mandrel. After the mandrel 86 has been removed, the shaft 22 is then typically processed through a size-grinding process and a surface finishing process to provide the shaft with desired shape, parameters and surface finish.

The inclusion of the sheet 40 of composite material in the shaft 22 provides a strengthening band 104 (FIGS. 1 and 9) at the butt end 28 of the shaft. The strengthening band 104 is formed integrally with the adjacent portions of the butt end 28 and precludes the undesirable initiation of splits and cracks at the outboard end of the butt end which might otherwise form due to the thinness of the lightweight shaft 22. The strengthening band 104 also prevents the propagation of the splits and cracks further into the shaft 22 toward the tip end 30 thereof.

Figure 8:
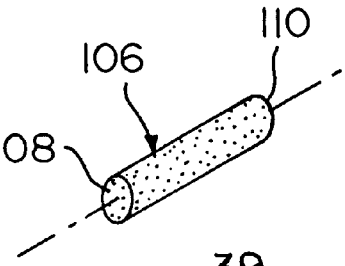
FIG. 8 is a perspective view showing a rod-like filler element which is composed of a lightweight material in a cellular form.

Referring to FIG. 8, a lightweight filler element 106 is rigid and is shaped in a configuration of a rod having a uniform diameter from one end 108 thereof to an opposite end 110. The element 106 is composed of a lightweight cellular polymer material such as a foam material which possesses excellent strength qualities. In the preferred embodiment, the foam is a phenolic foam commercially available under the trademark "THERMO-COR2" from American Foam Technologies, Route 1, Box 408A, Ronceverte, W.V. 24970. Other foam materials could be used without departing from the spirit and scope of the invention. Also, while the preferred embodiment of the element 106 is not formed with any radial or axial holes, elements with one or more of such holes could be used without departing from the spirit and scope of the invention.

In the preferred embodiment as shown in FIG. 9, an adhesive is applied to the exterior of the lightweight element 106 which is then inserted into a portion 27*a* of the axial opening 27 of the shaft 22 to enhance and strengthen the tip end 30 of the shaft. The adhesive could be a two-component thermoset epoxy adhesive or any other suitable bonding agent. Also, the adhesive could be applied initially into the portion 27*a* and/or onto the lightweight element 106. As illustrated in FIG. 9, the length of the element 106 is consistent with the length of the tip end 30 of the shaft 22 and, in its inserted position, is coincidental with the tip end to provide the maximum strengthening enhancement. However, strengthening elements of other materials, shapes and lengths could be used without departing from the spirit and scope of the invention.

In another technique for securing the lightweight element 106 within the portion 27*a* of the opening 27, the foam is liquified initially and then deposited in liquid form into the portion 27*a* and allowed to cure in this position. As an example, the axis of the shaft 22 can be placed in a horizontal orientation and a small amount of the liquid foam is deposited into portion 27*a* from the tip end 30. The shaft 22 is then oriented to a vertical position and the curing foam expands upward further into portion 27*a* and eventually cures in the desired location.

Currently, golf shafts which weigh less than sixty grams are considered to be ultralight in weight. Some shafts in this category have weighed as low as fifty to fifty-five grams.

The preferred embodiment of the shaft 22 is constructed with fewer layers of composite material than is normally used to provide the lightweight enhancement of the shaft and weighs about forty grams which is significantly below the lower end of the current shaft weights noted above. The lightweight shaft 22 employs the sheet 40 at the butt end 28 thereof to preclude undesirable splits and cracks in the outboard extremity of the butt end and employs the lightweight foam filler element 106 to strengthen the tip end 30 of the shaft. This permits the manufacture of the lightweight shaft 22 for use by golfers whose game is enhanced by the use of clubs which include such a lightweight shaft. also, the lightweight composite shaft 22 can be used with any type of golf club including drivers, irons, wedges and putters.

In general, the above-identified embodiments are not to be construed as limiting the breadth of the present invention. Modifications, and other alternative constructions, will be apparent which are within the spirit and scope of the invention as defined in the appended claims.

What is claimed is:

1. A lightweight shaft, which comprises:

a non-metallic body formed in a prescribed length along a linear axis thereof and which includes:

a first innermost layer of a material including fibers extending generally in an axial direction along and over the prescribed length of the body;

a second layer of material over the first layer including at least two sets of fibers confined in a single layer arranged in a biased matrix with respect to each other and extending along and over the prescribed length of the body;

a third layer of material over the second layer including fibers extending generally in an axial direction of the body and extending along and over the prescribed length of the body;

the first, second and third layers carried within a cured plastic matrix; and the body is formed with an end along the axis thereof with an opening formed in the end in a generally axial direction; and a lightweight filler element composed of a rigid cellular material located within the opening of the body.

2. The lightweight shaft as set forth in claim 1, wherein the fibers of one of the two sets of the second layer is woven with the fibers of the other of the two sets to form a fiber matrix.

3. The lightweight shaft as set forth in claim 1, wherein the fibers of one of the two sets of the second layer overlays the fibers of the other of the two sets.

4. The lightweight shaft as set forth in claim 1, wherein the fibers of one set of the two sets of the second layer are arranged at a forty-five degrees bias with the axis of the body and the fibers of the other of the two sets are arranged at a minus forty-five degree bias with the axis of the body.

5. The lightweight shaft as set forth in claim 1, wherein the filler element is composed of a rigid foam material.

6. The lightweight shaft as set forth in claim 1, wherein the filler element is formed in a shape of a holeless rod.

7. The lightweight shaft as set forth in claim 1, which further comprises:

a fourth layer of material over a portion of the third layer adjacent one end of the body and including at least two sets of fibers arranged in a biased matrix with respect to each other; and the fourth layer carried with the cured plastic matrix with the first, second and third layers.

8. The lightweight shaft as set forth in claim 7, wherein the fibers of one of the two sets of fibers of the fourth layer is woven with the fibers of the other of the two sets to form a fiber matrix.

9. The lightweight shaft as set forth in claim 7, wherein the fibers of one of the two sets of fibers of the fourth layer overlays the fibers of the other of the two sets.

10. The lightweight shaft as set forth in claim 7, wherein the fibers of one set of the two sets of fibers of the fourth layer are in axial alignment and parallel with the axis of the body and the fibers of the other set of fibers of the fourth layer are perpendicular to the fibers of the one set.

11. The lightweight shaft as set forth in claim 7, wherein the fibers of the first, second, third and fourth layers are composed of a graphite material.

12. The lightweight shaft as set forth in claim 7, wherein the cured plastic matrix is an epoxy resin matrix.

13. The lightweight shaft as set forth in claim 7, which further comprises:

an intermediate layer of material over the third layer and between the third and fourth layers and including fibers extending generally in an axial direction of the body; and the intermediate layer carried within the cured plastic matrix.

14. The lightweight shaft as set forth in claim 1, which further comprises:

a fourth layer of material over the third layer and including fibers extending generally in an axial direction of the body; and the fourth layer carried within the cured plastic matrix.

15. The lightweight shaft as set forth in claim 1, which further comprises an adhesive located between the filler element and an adjacent wall of the opening of the body to retain the element within the opening.

16. A lightweight shaft, which comprises:

a non-metallic body formed in a prescribed length along a linear axis thereof and which includes:

a first innermost layer of a material including fibers extending generally in an axial direction along and over the prescribed length of the body;

a second layer of material over the first layer including at least two sets of fibers arranged in a biased matrix with respect to each other and extending along and over the prescribed length of the body;

a third layer of material over the second layer including fibers extending generally in an axial direction of the body and extending along and over the prescribed length of the body;

a fourth layer of material over a portion of the third layer adjacent one end of the body and including at least two sets of fibers arranged in a biased matrix with respect to each other; and the first, second, third and fourth layers carried within a cured plastic matrix.

17. The lightweight shaft as set forth in claim 16, wherein the fibers of one of the two sets of fibers of the fourth layer is woven with the fibers of the other of the two sets to form a fiber matrix.

18. The lightweight shaft as set forth in claim 16, wherein the fibers of one of the two sets of fibers of the fourth layer overlays the fibers of the other of the two sets.

19. The lightweight shaft as set forth in claim 16, wherein the fibers of one set of the two sets of fibers of the fourth layer are in axial alignment and parallel with the axis of the body and the fibers of the other set of fibers of the fourth layer are perpendicular to the fibers of the one set.

20. The lightweight shaft as set forth in claim 16, wherein the fibers of the first, second, third and fourth layers are composed of a graphite material.

21. The lightweight shaft as set forth in claim 16, wherein the cured plastic matrix is an epoxy resin matrix.

22. A golf club, which comprises:

a lightweight shaft formed with a non-metallic body formed in a prescribed length along a linear axis thereof, which includes:

a first innermost layer of a material including fibers extending generally in an axial direction along and over the prescribed length of the body;

a second layer of material over the first layer including at least two sets of fibers arranged in a biased matrix with respect to each other and extending along and over the prescribed length of the body;

a third layer of material over the second layer including fibers extending generally in an axial direction of the body and extending along and over the prescribed length of the body;

the first, second and third layers carried within a cured plastic matrix; and the body is formed with an end along the axis thereof with an opening formed in the end in a generally axial direction;

a lightweight filler element located within the opening of the body;

a club head mounted on the end of the shaft which includes the filler element located in the opening; and a grip mounted on an end of the shaft opposite the end on which the club head is mounted.

23. A golf club, which comprises:

a lightweight shaft formed with a non-metallic body in a prescribed length along a linear axis thereof, which includes:

a first innermost layer of a material including fibers extending generally in an axial direction along and over the prescribed length of the body;

a second layer of material over the first layer including at least two sets of fibers arranged in a biased matrix with respect to each other and extending along and over the prescribed length of the body;

a third layer of material over the second layer including fibers extending generally in an axial direction of the body and extending along and over the prescribed length of the body;

a fourth layer of material over a portion of the third layer adjacent one end of the body and including at least two sets of fibers arranged in a biased matrix with respect to each other; and the first, second, third and fourth layers carried within a cured plastic matrix;

a club head mounted on an end of the shaft opposite the one end at which the fourth layer is located; and a grip mounted on the one end of the shaft.

24. A method of making a lightweight shaft which includes the steps of:

forming at least a first sheet and a second sheet of a material having a plurality of non-metallic fibers extending in a generally-parallel longitudinal direction and carried by an uncured plastic material which forms a portion of the first and second sheets;

forming a third sheet and a fourth sheet of material wherein each sheet includes a first plurality of non-metallic fibers extending in a generally parallel alignment and also include a second plurality of non-metallic fibers which are in a generally parallel alignment wherein the first plurality of fibers of each of the third and fourth sheets cross the second plurality of fibers at a prescribed angle of fiber orientation and where all of the fibers of the third and fourth sheets are carried by an uncured plastic material which forms a portion of the third and fourth layers;

wrapping the first sheet of material around a rigid mandrel such that the fibers thereof extend longitudinally of the mandrel;

wrapping the third sheet of material around the first sheet of material;

wrapping the second sheet of material around the third sheet of material such that the plurality of fibers of the second sheet extend longitudinally of the mandrel;

wrapping the fourth sheet of material around a portion of the second sheet of material which extends from a first end of the second sheet for a prescribed distance toward a second end of the second sheet to thereby form an assembly;

processing the uncured plastic material of the first, second, third and fourth sheets of material to blend together and cure in a unitized structure; and removing the mandrel to provide the lightweight shaft with four layers of material having non-metallic fibers oriented in a prescribed manner.

25. The method of making a lightweight shaft as set forth in claim 24 wherein the fibers of the fourth layer are located at one end of the shaft, which further comprises the steps of:

forming an opening in an end of the shaft opposite the one end thereof by placement of the mandrel during the wrapping steps and the subsequent removal of the mandrel;

forming a lightweight filler element in a shape of a rod; and inserting the element into the opening formed in the shaft.

26. The method of making a lightweight shaft as set forth in claim 25, which further comprises the step of applying an adhesive between the filler element and an adjacent wall of the opening.

27. The method of making a lightweight shaft as set forth in claim 24 wherein the fibers of the fourth layer are located at one end of the shaft, which further comprises the steps of:

forming an opening in an end of the shaft opposite the one end thereof by placement of the mandrel during the wrapping steps and the subsequent removal of the mandrel;

liquefying a filler material;

depositing the liquefied filler material into the opening of the shaft; and curing the liquified deposited material to form a solidified filler element within the opening.

28. A method of making a lightweight shaft which includes the steps of:

forming at least a first sheet and a second sheet of a material having a plurality of non-metallic fibers extending in a generally-parallel longitudinal direction and carried by an uncured plastic material which forms a portion of the first and second sheets;

forming a third sheet of material which includes a first plurality of non-metallic fibers extending in a generally parallel alignment and also includes a second plurality of non-metallic fibers which are in a generally parallel alignment wherein the first plurality of fibers cross the second plurality of fibers at a prescribed angle of fiber orientation and wherein the first and second plurality of fibers of the third sheet are carried in the angled orientation by an uncured plastic material which also forms a portion of the third sheet;

wrapping the first sheet of material around a rigid mandrel such that the fibers thereof extend longitudinally of the mandrel;

wrapping the third sheet of material around the first sheet of material;

wrapping the second sheet of material around the third sheet of material such that the plurality of fibers of the second sheet extend longitudinally of the mandrel;

processing the uncured plastic material of the first, second and third sheets of material to blend together and cure in a unitized structure;

removing the mandrel from assembly with the cured first, second and third sheets to reveal an opening in the cured sheets;

forming a lightweight filler element in a shape of a rod; and inserting the element into the opening formed in the cured sheets.

* * * * *